US005163191A

United States Patent [19]

Chan

[11] Patent Number: 5,163,191

[45] Date of Patent: Nov. 17, 1992

[54] REPLACEABLE TWO-LEVEL CRIB DRAPE

[76] Inventor: Te-Erh Chan, 9th Fl., 49, Chung Ching South Road, Sec. 1, Taipei, 100, Taiwan

[21] Appl. No.: 869,811

[22] Filed: Apr. 14, 1992

[51] Int. Cl.[5] ..... A47D 7/00; A47D 13/06

[52] U.S. Cl. ..... 5/98.1; 5/99.1; 24/387

[58] Field of Search ..... 5/98.1, 99.1, 98.2, 5/98.3, 93.1, 93.2; 24/387

[56] References Cited

U.S. PATENT DOCUMENTS

| | | | |
|---|---|---|---|
| 2,587,255 | 2/1952 | Vogel et al. | 5/99.1 |
| 3,438,069 | 4/1969 | Long | 5/98.1 |
| 3,606,620 | 9/1971 | Glover | 5/98.1 |
| 4,538,309 | 9/1985 | Gunter | 5/99.1 |
| 4,811,437 | 3/1989 | Dillner et al. | 5/99.1 |

*Primary Examiner*—Alexander Grosz
*Attorney, Agent, or Firm*—W. Wayne Liauh

[57] ABSTRACT

A replaceable two-level crib drape mainly consists of a main drape and an upper drape. The main drape has four wings formed at its four corners to vertically wrap around posts of a crib skeleton, and four top sheets formed at top of its four sides to horizontally wrap around transoms of the crib skeleton. The wrapped-around wings and top sheets are sealed with zippers so that they would form sleeves covering and firmly attaching to the posts and the transoms of the crib. The upper drape may be detachably connected to the main drape by turning outward and then sealing its four top sheets to the top sheets of the main drape with zippers provided thereat and by joining zippers provided at four corners of the main drape and the upper drape.

2 Claims, 3 Drawing Sheets

REPLACEABLE TWO-LEVEL CRIB DRAPE

BACKGROUND OF THE INVENTION

Most currently used cribs use fixedly attached drape, one example of such fixed crib drape is the Foldabe Playyard as disclosed in U.S. Pat. No. 4,811,437. However, these cribs with fixedly attached drape have following disadvantages:

1. The drape is not removable from the crib for cleaning purpose, that is, the drape must be cleaned together with the crib. So, it is inconvenient to wash the crib and it takes more time to get the entire wet crib dried. In addition, skeleton of the crib must be well anti-rust treated so that it is suitable for cleaning with water.

2. Whenever the drape is worn out or damaged, the entire crib must be discarded and wasted because the drape is not replaceable.

3. The crib with fixedly attached drape usually has only one lower bottom drape for holding the baby. Since a lower bottom has closer distance from the ground and therefore, the crib shall be surrounded by air with higher flow rate. Baby sleeping in such a lower bottom crib catches cold easily. In addition, one who wants to lift up or lay down a baby from or into the crib which has lower bottom, more efforts are needed.

In brief, the foldable crib as disclosed in the aforesaid U.S. patent shall have higher skeleton cost and shall very possibly cause unnecessary waste because the entire crib must be discarded when the drape thereon is worn out or damaged for any reason.

SUMMARY OF THE INVENTION

It is therefore tried by the applicant to develop a replaceable crib drape that can be freely attached to or removed from the skeleton of a crib for cleaning and replacement purpose. By this way, the crib may have longer life of use. In addition, the above-mentioned replaceable crib drape is designed to have two different levels so that the crib can be used according to actual need.

BRIEF DESCRIPTION OF THE DRAWINGS

The present invention may be more clearly understood by referring to the following detailed description of preferred embodiment and the accompanying drawings wherein.

DETAILED DESCRIPTION OF THE PREFERRED EMBODIMENTS

Figure 1:
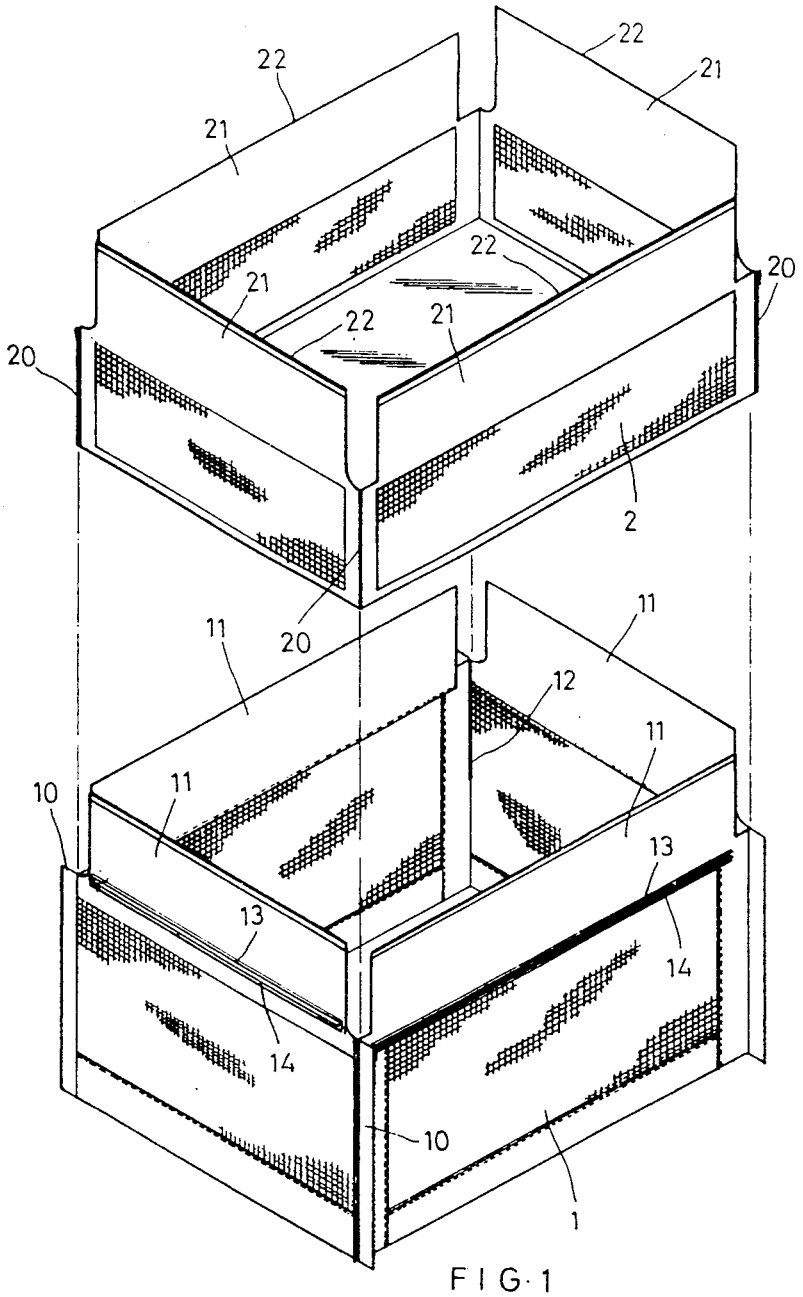
FIG. 1 is a three-dimensional analytical perspective of a crib drape according to the present invention.
Figure 2:
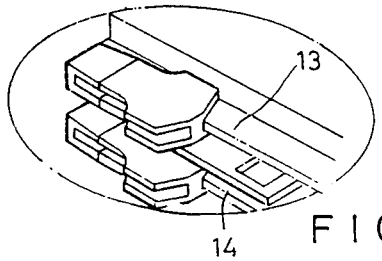
FIG. 2 is a fragmentary and enlarged view of FIG. 1.

The present invention includes a main drape 1 and an upper drape 2. The main drape 1 has a bottom, four sides, four wings 10 laterally extending from outer corners formed by every two sides, and four top sheets 11 upwardly extending from upper edge of the four sides of the main drape 1. Each of the wings 10 may be vertically turned around to connect with one side of the main drape 1 with a first zipper 15 thereat and therefore, forms a vertical sleeve thereat. Each of the four top sheets 11 may be downward turned around to connect with one side of the main drape 1 with a second zipper 13 transversely sewed on the conjuncture of the side with the top sheet 11 and therefore, forms a horizontal sleeve thereat. A third zipper 12 is separately sewed on to inner side of each corner of the main drape 1 in vertical direction and in proper length. A sixth zipper 14 is sewed on each of the conjunctures of the sides with the top sheets 11 below and in parallel to the second zippers 13.

The upper drape 2 has a bottom, four sides, and four top sheets 21 upward extending from top edge of the four sides. The upper drape 2 has smaller height than that of the main drape 1 and therefore, has a bottom closer to top edge of the top edge of the sides. A fourth zipper 20 is sewed on to outer side of each corner formed by every two sides while a fifth zipper 22 is sewed on the outer edge of each top sheet 21.

The upper drape 2 may be detachably connected to the main drape 1 to form an integral body by sealing each of the fourth zippers 20 to each of the corresponding third zippers 12.

Figure 3:
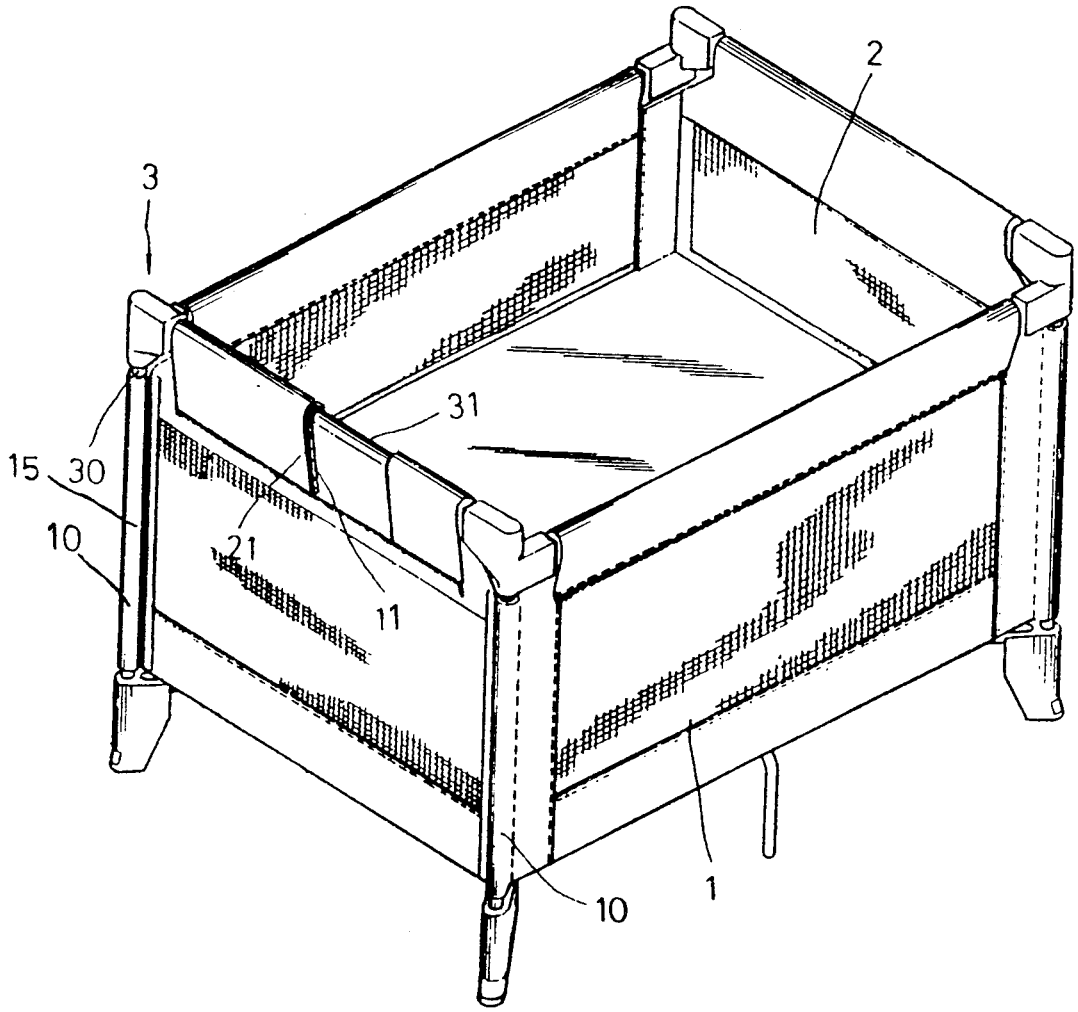
FIG. 3 is a three-dimensional perspective of a crib drape according to the present invention wherein a main and an upper drapes are used.
Figure 4:
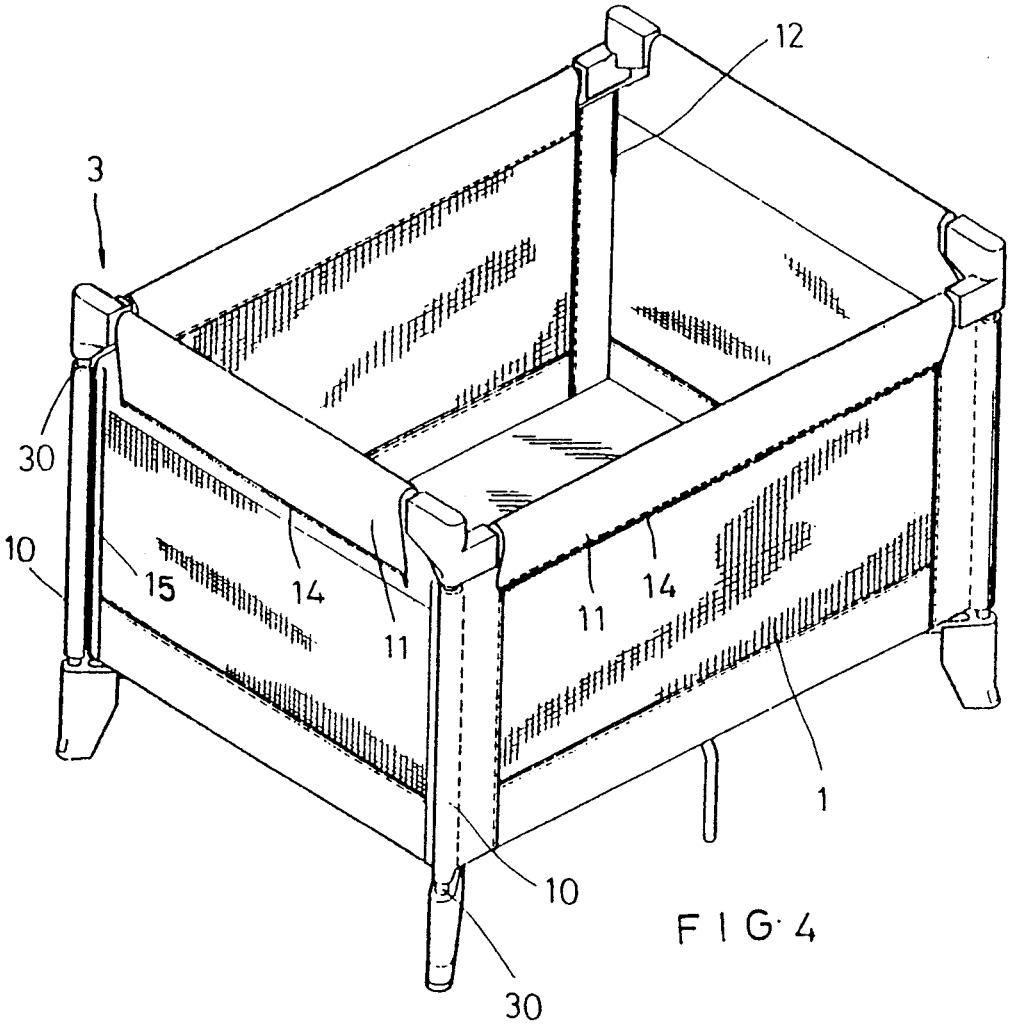
FIG. 4 is a three-dimensional perspective of a crib drape according to the present invention wherein only the main drape is used.

The crib drape according to the present invention has to be used together with a set of crib skeleton 3 as shown in FIG. 3. To assemble a complete crib, just position the main drape 1 inside the crib skeleton 3, have its four wings 10 wrapped around four posts 30 of the skeleton 3 and then seal each of the vertical sleeves formed by the wrapped-around wings 10 with the first zipper 15. Secondly, have the four top sheets 11 downward wrapped around four transoms 31 of the skeleton 3 and then seal each of the horizontal sleeves formed by the wrapped-around top sheets 11 with the second zipper 13. To attach the upper drape 2 to the assembled crib as described above, first have the top sheets 21 of the upper drape 2 downward wrapped around the transoms 31 already covered by top sheets 11, then, separately seal each of the fifth zippers 22 at outer edge of the top sheets 21 with a sixth zipper 14. As shown in FIG. 3, a crib with an upper drape 2 attached may be used to hold an infant. The smaller depth thereof shall make the lift up or put down of an infant from or into the crib more conveniently. To have a crib having larger depth as shown in FIG. 4, just detach the upper drape 2 from the top of the main drape 1. To detach the upper drape 2 from the crib, first separate each of the fifth zipper 22 at outer edge of each top sheets 21 from the corresponding sixth zippers 14 on each side of the main drape 1. Second, separate each of the third zippers 12 at each corner of the main drape 1 from the corresponding fourth zippers 20 at each corner of the upper drape 2. And then, detach the upper drape 2 from the crib.

The advantages of the crib drape according to the present invention are:

1. When the crib drape is worn out or damaged, it can be replaced alone without discarding the crib skeleton. The life of use of the crib is extended.

2. Two different levels of crib bottoms are available while a conventional drape-type crib has only one bottom with fixed height.

3. The crib drape according to the present invention can be easily detached from the crib for cleaning purpose.

Figure 5:
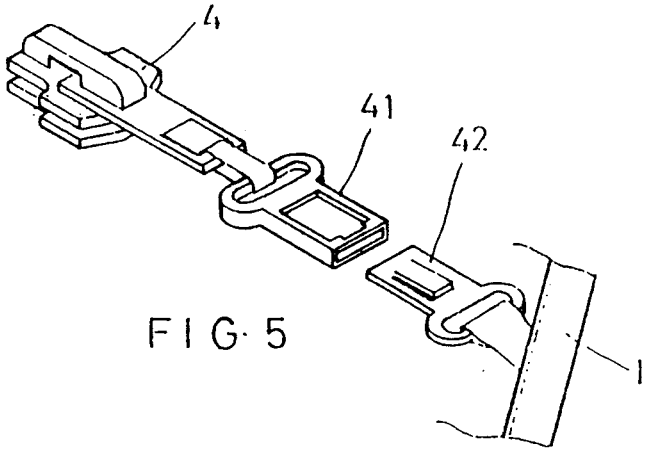
FIG. 5 shows a zipper used in the present invention the tab of which has enhanced slip-free capability by adding to it specially designed fastening means.

The zippers used by the present invention are slip-free zippers (which is a known prior art) which provide enough binding strength to safely connect the crib drapes 1, 2 to each other and to the crib skeleton 3. However, to further secure the slip-free capability of the zippers, a female retaining means 41, as shown in FIG. 5, may be connected to the sliding tab 4 of each zipper and a male retaining means 42 may be connected to the end of each corresponding zipper, especially those on the main drape 1. When these female and male retaining means 41, 42 engage with one another, the zippers may provide higher security.

With the present invention, the shortcomings existing in the conventional drape-type cribs can be eliminated, the life of use of the crib is extended, the value of the crib is enhanced, and the cost paid by the consumers is lowered.

What is claimed is:

1. A replaceable two-level crib drape, comprising a main drape and an upper drape;

said main drape having a bottom, four sides, four wings laterally extending from outer corners formed by every two of said sides, and four top sheets upwardly extending from upper edge of said four sides of said main drape;

each of said wings being capable of being vertically turned around to connect with one side of said main drape with a first zipper thereat and therefore, forming a vertical sleeve thereat;

each of said four top sheets being capable of being downwardly turned around to connect with one side of said main drape with a second zipper transversely sewed on conjuncture of said side with said top sheet and therefore, forming a horizontal sleeve thereat;

said main drape also having a third zipper being separately sewed on to inner side of each corner of said main drape in a vertical direction and in proper length, and a sixth zipper being sewed on each of said conjunctures of said sides with said top sheets below and in parallel to said second zippers;

said upper drape having a bottom, four sides, and four top sheets extending upwardly from the top edges of said four sides;

said bottom of said upper drape being closer to the top edge of said four sides thereof than said bottom of said main drape to the top edge of said four sides thereof;

said top sheets of said upper drape being capable of being downwardly turned to cover said top sheets of said main drape;

said upper drape also having a fourth zipper sewed on to each corner formed by every two of said sides thereof, with a fifth zipper being sewed on outer edge of each of said top sheet of said upper drape; and said upper drape being capable of being detachably connected to said main drape to form an integral body when each of said fourth zippers is sealed to each of said corresponding third zippers and each of said fifth zippers on outer edge of said top sheet of said upper drape is sealed to each of said sixth zippers below said second zippers on said main drape.

2. A replaceable two-level crib drape as claimed in claim 1, wherein each of said zippers have a female retaining means connected to the ends of the sliding tab portions of said zippers and a male retaining means connected to said female retaining means to more securely retain said zippers in a connected mode.

* * * * *